US008330697B2

(12) United States Patent
Lee

(10) Patent No.: US 8,330,697 B2
(45) Date of Patent: Dec. 11, 2012

(54) METHODS AND LIQUID CRYSTAL DISPLAY DEVICES THAT REDUCE/AVOID TEARING EFFECTS IN DISPLAYED IMAGES

(75) Inventor: Jae-hoon Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 1203 days.

(21) Appl. No.: 11/821,808

(22) Filed: Jun. 26, 2007

(65) Prior Publication Data

US 2008/0174540 A1 Jul. 24, 2008

(30) Foreign Application Priority Data

Jan. 23, 2007 (KR) ..... 10-2007-0007251

(51) Int. Cl.
*G09G 3/36* (2006.01)

(52) U.S. Cl. ..... 345/99

(58) Field of Classification Search ..... 345/98, 345/99, 87, 204, 213, 690
See application file for complete search history.

(56) References Cited

U.S. PATENT DOCUMENTS

| | | | | |
|---|---|---|---|---|
| 5,359,265 | A * | 10/1994 | Kii et al. | 315/367 |
| 5,764,212 | A * | 6/1998 | Nishitani et al. | 345/98 |
| 5,818,468 | A * | 10/1998 | Le Cornec et al. | 345/535 |
| 5,914,757 | A * | 6/1999 | Dean et al. | 348/584 |
| 6,680,990 | B1 * | 1/2004 | Yoshida et al. | 375/372 |
| 7,675,522 | B2 * | 3/2010 | Kubota et al. | 345/534 |
| 7,889,191 | B2 * | 2/2011 | Simpson | 345/213 |
| 2002/0021300 | A1 * | 2/2002 | Matsushita | 345/534 |
| 2005/0110784 | A1 * | 5/2005 | Kang et al. | 345/204 |
| 2006/0114219 | A1 * | 6/2006 | Park | 345/102 |
| 2006/0164424 | A1 * | 7/2006 | Wiley et al. | 345/539 |
| 2007/0159490 | A1 * | 7/2007 | De Greef | 345/546 |

FOREIGN PATENT DOCUMENTS

| | | |
|---|---|---|
| JP | 09-023441 | 1/1997 |
| JP | 2002-132237 | 5/2002 |
| JP | 2002-215081 | 7/2002 |
| JP | 2005-124167 | 5/2005 |
| WO | WO 2005004103 A1 * | 1/2005 |
| WO | WO 2005/073955 A1 | 8/2005 |

OTHER PUBLICATIONS

Chinese First Office Action Corresponding to Chinese Patent Application No. 2008100085606; Dated: Jul. 13, 2011; 9 pages, English Translation thereof, 12 pages.
Chinese Office Action Corresponding to Chinese Patent Application No. 200810008560.6; Dated: Feb. 23, 2012; Chinese Text, 7 pages, English Translation Thereof, 9 pages.

* cited by examiner

*Primary Examiner* — Chanh Nguyen
*Assistant Examiner* — Kwang-Su Yang
(74) *Attorney, Agent, or Firm* — Myers Bigel Sibley & Sajovec, P.A.

(57) ABSTRACT

Methods and related liquid crystal display devices are disclosed that reduce/avoid a tearing effect in displayed images. A scan time of a scan clock signal of a display is detected. A write time of a write clock signal that writes data into a memory for display on the display is detected. The write time is regulated in response to a comparison of the scan time of the scan clock signal to the write time of the write clock signal.

6 Claims, 7 Drawing Sheets

METHODS AND LIQUID CRYSTAL DISPLAY DEVICES THAT REDUCE/AVOID TEARING EFFECTS IN DISPLAYED IMAGES

CROSS-REFERENCE TO RELATED PATENT APPLICATION

This application claims the benefit of Korean Patent Application No. 10-2007-0007251, filed on Jan. 23, 2007, in the Korean Intellectual Property Office, the disclosure of which is incorporated herein in its entirety by reference.

FIELD OF THE INVENTION

The present invention relates to methods of displaying images and related liquid crystal display (LCD) devices.

BACKGROUND OF THE INVENTION

Liquid crystal displays (LCDs), such as thin film transistor LCDs, are increasingly being used in electronic devices, such as in mobile phones. One design constraint on the use of LCDs is their ability to provide sufficiently compact and low-cost displays capable of clearly displaying moving images. New controllers have emerged that are targeted at specifically controlling the display of moving images on LCDs. However, these specialized controllers may be prohibitively expensive for use in some electronic devices, such as in some mobile phones. Moreover, the display architecture may require the use of a conventional controller along with the specialized controller. The use of two controllers may lead to the use of interrupt-based processing for large amounts of image data, which may decrease the efficiency at which moving images are processed and may increase the complexity of the control software.

FIG. 1A illustrates a conventional LCD device 100. Referring to FIG. 1A, the LCD device 100 includes an LCD panel 101, an LCD driver 110, and a controller 120.

The controller 120 controls the display of image data on the LCD panel 101. The controller 120 generates and outputs control signals, which can include a chip selection "CS" signal, a write clock "WR" signal, a DATA signal, and the like.

The CS signal is used to select and enable individual pixels on the LCD panel 101. The WR signal is used to write data (e.g., image data), which is received from circuitry external to the LCD device 100, to a memory 113 included in the LCD driver 110. Hereinafter, the write clock signal will be referred to as CLK_W. The DATA signal refers to image data that is generated from data that is received from circuitry that is external to the LCD device 100.

The LCD driver 110 includes a source driver/gate driver 111, the memory 113, and an oscillator 115.

The image data from the controller 120 is written into the memory 113. The write operation is performed using the write clock signal CLK_W which is output by the controller 120, and which may be used as an internal operational clock for the controller 120.

The source driver/gate driver 111 reads the image data from the memory 113 and outputs therefrom an image signal to the LCD panel 101 in response to a control signal which is generated by the controller 120.

The source driver/gate driver 111 also responds to the control signal transmitted from the controller 120 by controlling positioning of the image signal on the LCD panel 101. Such structure and operation of the source driver/gate driver 111 is well known to those of ordinary skill in the art and, accordingly, further details thereof will be omitted for brevity.

The oscillator 115 generates a scan clock signal CLK_FLM which is used by the LCD driver 110 to scan an image signal from the source driver/gate driver 111 onto the display of the LCD panel 101. The scanning operation using the scan clock signal CLK_FLM will be described with reference to FIG. 1B.

FIG. 1B is a timing diagram that illustrates relative timing between the write clock signal CLK_W and the scan clock signal CLK_FLM and operation thereof, and further illustrates a tearing effect that occurs during the operation of the LCD device 100.

In the conventional LCD device 100 of FIG. 1A, the write clock signal CLK_W, used for regulating writing of image data into the memory 113, and the scan clock signal CLK_FLM, used to scan image data on the display of the LCD panel 101, are not synchronized to one another.

Referring to FIG. 1B, when the scan clock signal CLK_FLM is low, the image signal is scanned to pixels in the LCD panel 101. A bottom pixel line is referred to as Line 1 and a top pixel line is referred to as Line 160. When the scan clock signal CLK_FLM generated by the oscillator 115 is low, the LCD driver 110 performs a scanning operation from Line 1 of the LCD panel 101 up to Line 160 of the LCD panel 101.

When the write clock signal CLK_W is low, the image data transmitted by the controller 120 is written to the memory 113. The write operation is performed in units of frame data. In other words, the image data is written during the low level period of the write clock signal CLK_W and single frame data is written to the memory 113 during a single interval of the low level period. For reference, a general scan clock signal CLK_FLM can have a frequency of 60 Hz and a general write clock signal CLK_W can have a frequency band of 15-30 Hz. Thus, when the scanning operation is performed three or four times, the write operation is performed once. When new image data is not input, the LCD driver 110 scans stored image data and displays the image data on the LCD panel 101.

In the LCD device 100, the write clock signal CLK_W and the scan clock signal CLK_FLM are not synchronized with each other. Moreover, the duration of the low level period of the write clock signal CLK_W can be constant, and an operating frequency band and an active period are not matched. Consequently, at a point "a" in FIG. 1B, the write clock signal CLK_W and the scan clock signal CLK_FLM, overlap each other at timing coordinates (a, X).

FIG. 1C illustrates an image that is displayed on the LCD panel 101 and which exhibits a tearing effect as a result of the relative signal timing shown in FIG. 1B.

Before time "a", the LCD driver 110 scans the image data that was previously stored in the memory 113. However, after time "a", the LCD driver 110 scans image data that is newly stored in the memory 113 after the time "a". In the example of FIG. 1C, the LCD driver 110 displays white pixel color from Line 1 to a line X in response to the image data that was stored in the memory 113 before time "a", and displays black pixel color from the line X to Line 160 in response to other image data that was stored in the memory 113 after time "a".

Accordingly, a tearing effect in the displayed image occurs at the line X of the LCD panel 101. The tearing effect corresponds to a lack of logical association among image data that is displayed on the LCD panel 101. In the present example, the white pixels are associated with the same image, however the black pixels are associated with another image that is intended to displayed subsequent to the display of the white image. The timing intersection of the scan clock signal CLK_

FLM and the write clock signal CLK_W corresponds to the location of the tearing effect on the image that is displayed on the LCD device 101.

FIG. 2A illustrates a conventional LCD device 200 device that is configured to attempt to prevent the occurrence of a tearing effect.

The LCD device 200 includes an LCD panel 201, an LCD driver 210, and a controller 220, which can be configured to operate in a similar manner to the LCD panel 101, the LCD 110, and the controller 120 described above, and, accordingly, further description of these components is omitted for brevity.

In an attempt to prevent a tearing effect in a displayed image, the LCD device 200 includes a synchronization processing unit 222 in the controller 220. The operation of the synchronization processing unit 222 will be described in detail with reference to FIG. 2B.

FIG. 2B is a block diagram that illustrates various operations of the controller 220 and the LCD driver 210.

Referring to FIG. 2B, the controller 220 of the LCD device 200 receives a signal FLM_Vsync providing synchronization information for a scan clock signal from the LCD driver 210. The synchronization processing unit 222 of the controller 220 is configured to synchronize the write clock signal CLK_W with the scan clock signal CLK_FLM using the received signal FLM_Vsync. The synchronization processing unit 222 synchronizes the scan clock signal CLK_FLM and the write clock signal CLK_W in response to each transition of the write clock signal CLK_W from high to low.

In the conventional LCD devices 100 and 200 illustrated in FIG. 1A and FIG. 2A, the controllers 120 and 220 cannot perform other operations (i.e., stop carrying-out other operations) while they process image data. Because other operations are interrupted while image data is processed, the processing can be referred to as interrupt processing.

If such interrupt processing is to be avoided, thereby avoiding interruption of other operations in response to the input of a signal FLM, the LCD device 200 illustrated in FIG. 2A can include a separate processor that is configured to synchronize the write clock signal CLK_W in response to the input signal FLM_Vsync. The separate processor may be included in the synchronization processing unit 222 of the LCD device 200.

FIG. 2C is a timing diagram illustrates relative timing between the write clock signal CLK_W and the scan clock signal CLK_FLM during the operation of the LCD device 200 of FIG. 2A. Referring to FIG. 2C, when the write clock signal CLK_W is synchronized with the scan clock signal CLK_FLM, an intersecting point "a" between such signals described in FIG. 1B does not occur and, therefore, occurrence of the tearing effect may thereby be reduced.

Although the tearing effect is reduced, the inventors of the present application have determined that the tearing effect may not be completely prevented, possibly because of a change in the operating frequency of the scan clock signal CLK_FLM and/or dispersion of the write clock signal CLK_W generated by the controller 220.

As described above, in the conventional LCD device 100, the scan clock signal CLK_FLM and the write clock signal CLK_W are not synchronized with each other and the write speed of the write clock signal CLK_W is constant, which results in occurrence of the tearing effect.

Moreover, although the LCD device 200 can reduce the occurrence of the tearing effect, the synchronization processing unit 220 needs to have a separate processor that carries out the signal synchronization. Furthermore, the tearing effect may not be completely prevented, possibly because of changes in the operating frequency of the scan clock signal CLK_FLM and/or dispersion of the write clock signal CLK_W generated by the controller 220.

SUMMARY OF EMBODIMENTS OF THE INVENTION

Various embodiments of the present invention are directed to reducing/avoiding the occurrence of a tearing effect in displayed images, and which may be provided although the signal interfaces to a display device are subjected to varying frequencies and without necessitating the use of a plurality of separate processors with a display driver.

A method of reducing/avoiding a tearing effect in displayed images can include detecting a scan time of a scan clock signal of a display, detecting a write time of a write clock signal that writes data into a memory for display on the display, and regulating the write time in response to a comparison of the scan time to the write time.

In some further embodiments, the write time of the write clock signal may be regulated by adjusting the write time to be equal to the scan time of the scan clock signal. When the write time is greater than the scan time, the write time can be reduced in response to the difference between the write time and the scan time. When the write time is less than the scan time, the write time can be increased in response to the difference between the write time and the scan time.

In some further embodiments, color information can be written to the memory at a rate that is controlled by the regulated write time of the write clock signal. The memory can be configured as a display memory for a liquid crystal display (LCD) driver. The color information can be scanned from the memory onto a LCD panel. The color information can be scanned from the memory in response to the scan clock signal to control colors of pixels of the LCD panel. The color information for each of the pixels of the LCD panel can be written to the memory in response to the write clock signal.

In some further embodiments, the color information for an entire screen of pixels of the LCD panel can be repetitively scanned at a rate corresponding to the scan time. The color information for an entire screen of pixels of the LCD panel can be repetitively written to the memory at a rate corresponding to the write time.

Some other embodiments of present invention are directed to a LCD device that includes an LCD panel, a controller, and an LCD driver. The controller is configured to receive image data from circuitry external to the LCD device and to generate a write clock signal defining a write time. The LCD driver is configured to store image data from the controller at a rate defined by the write time of the write clock signal, to generate a scan clock signal having a scan time, and to generate an image signal in response to the stored image data. The image signal has a rate defined by the scan time of the scan clock signal. The LCD driver scans the image signal into the LCD panel at a rate defined by the scan time of the scan clock signal to display an image on the LCD panel. The controller regulates the write time of the write clock signal in response to a comparison of the scan time of the scan clock signal to the write time of the write clock signal.

In some further embodiments, the controller detects the write time of the write clock signal, detects the scan time of the scan clock of the scan clock signal, compares the scan time of the scan clock signal to the write time of the write clock signal, and adjusts the write time of the write clock signal in response to the comparison.

In some further embodiments, the controller adjusts the write time of the write clock signal to the equal to the scan time of the scan clock signal.

In some further embodiments, the LCD driver comprises a memory, and writes image data from the controller into the memory at a rate defined by the write time of the write clock signal.

In some further embodiments, the LCD driver further includes an oscillator that generates the scan clock signal.

In some further embodiments, the LCD driver further includes a source driver that is configured to read the image data from the memory and to output the image signal to the LCD panel at a rate defined by the write time of the write clock signal, and includes a gate driver that is configured to respond to the write clock signal to control a position where the image signal is to be displayed.

In some further embodiments, the controller responds to the write time being greater than the scan time by reducing the write time, and responds to the write time being less than the scan time by increasing the write time. The controller may adjust the write time to be equal to the scan time.

In some further embodiments, the LCD driver includes a memory. The image data includes color information. The LCD driver is further configured to output the color information from the memory to the LCD panel to control colors of pixels of the LCD panel in response to the scan clock signal. The LCD driver may be further configured to repetitively display the color information for an entire screen of pixels of the LCD panel at a rate corresponding to the scan time, and to repetitively write to the memory the color information for an entire screen of pixels of the LCD display at a rate corresponding to the write time.

BRIEF DESCRIPTION OF THE DRAWINGS

The above and other features and potential advantages of the present invention will become more apparent by describing in detail exemplary embodiments thereof with reference to the attached drawings in which.

DETAILED DESCRIPTION OF EMBODIMENTS OF THE INVENTION

Figure 1A:
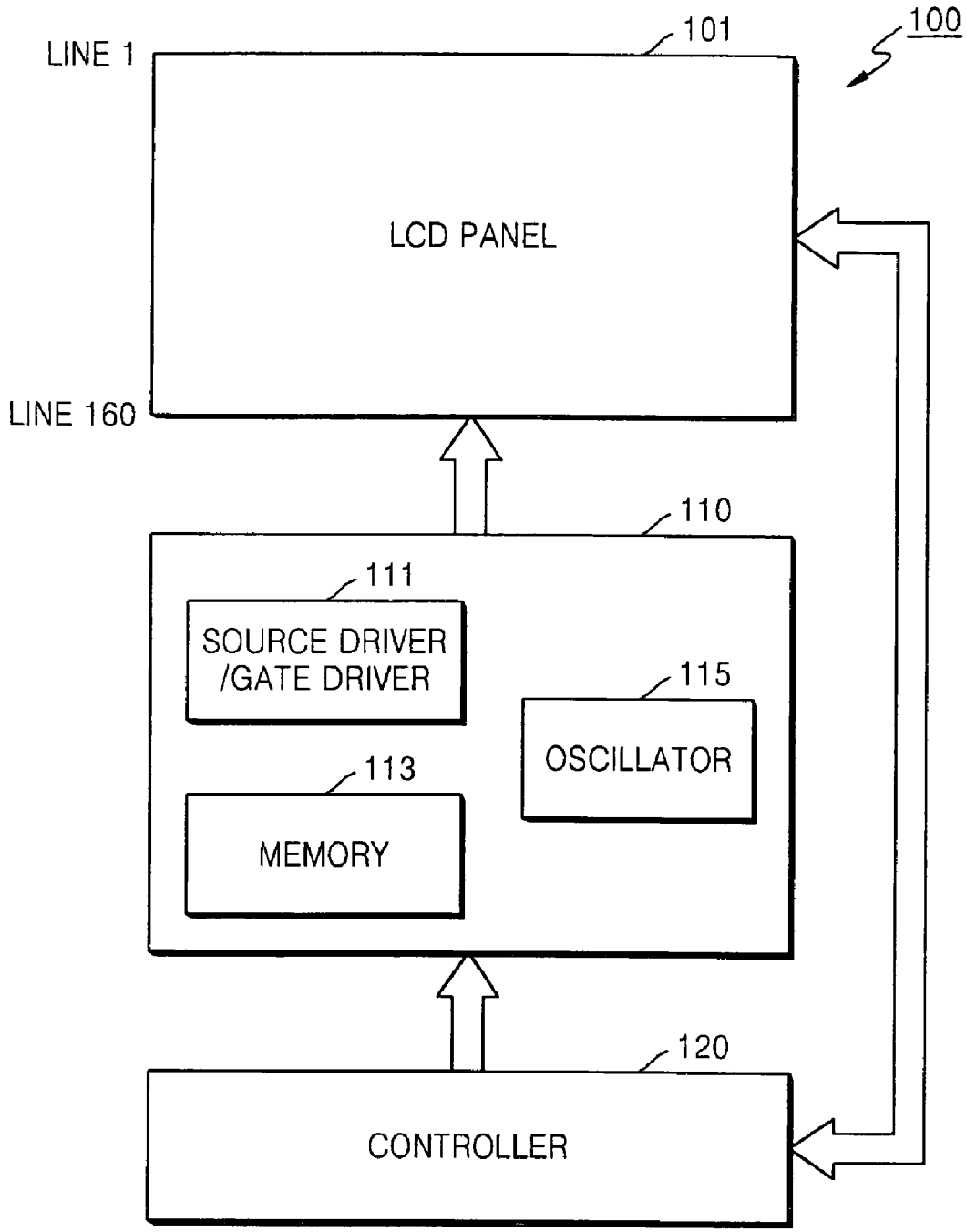
FIG. 1A (RELATED ART)
FIG. 1A illustrates a conventional liquid crystal display (LCD) device.
Figure 1B:
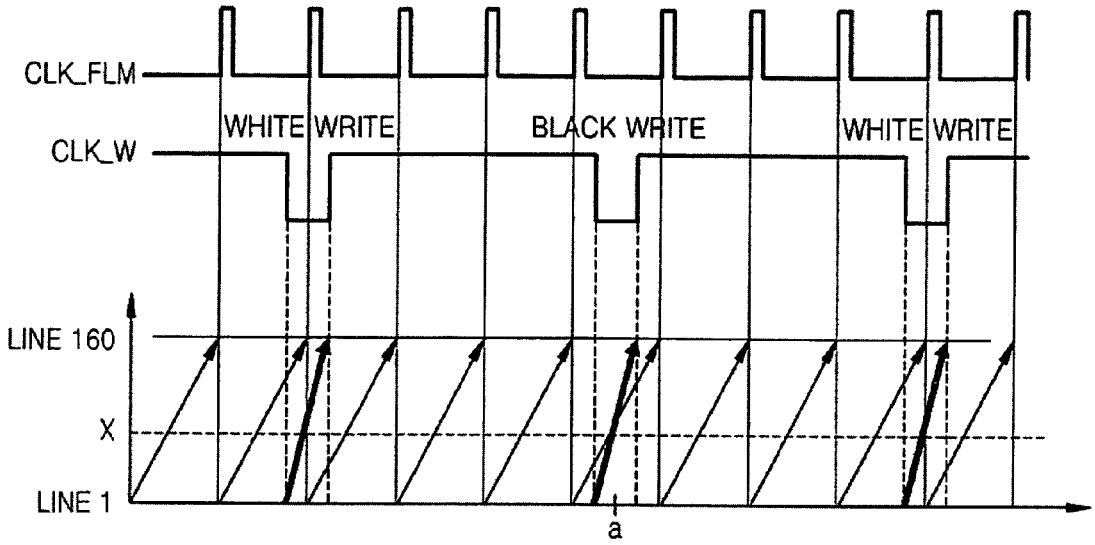
FIG. 1B (RELATED ART)
FIG. 1B is a timing diagram that illustrates relative timing between the write clock signal CLK_W and the scan clock signal CLK_FLM and operation thereof, and further illustrates a tearing effect that occurs during the operation of the LCD device of FIG. 1A.
Figure 1C:
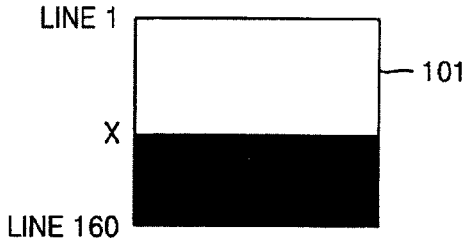
FIG. 1C (RELATED ART)
FIG. 1C illustrates an LCD screen that may occur as a result of a tearing effect caused by the signal timing of FIG. 1B.

The present invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Is The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
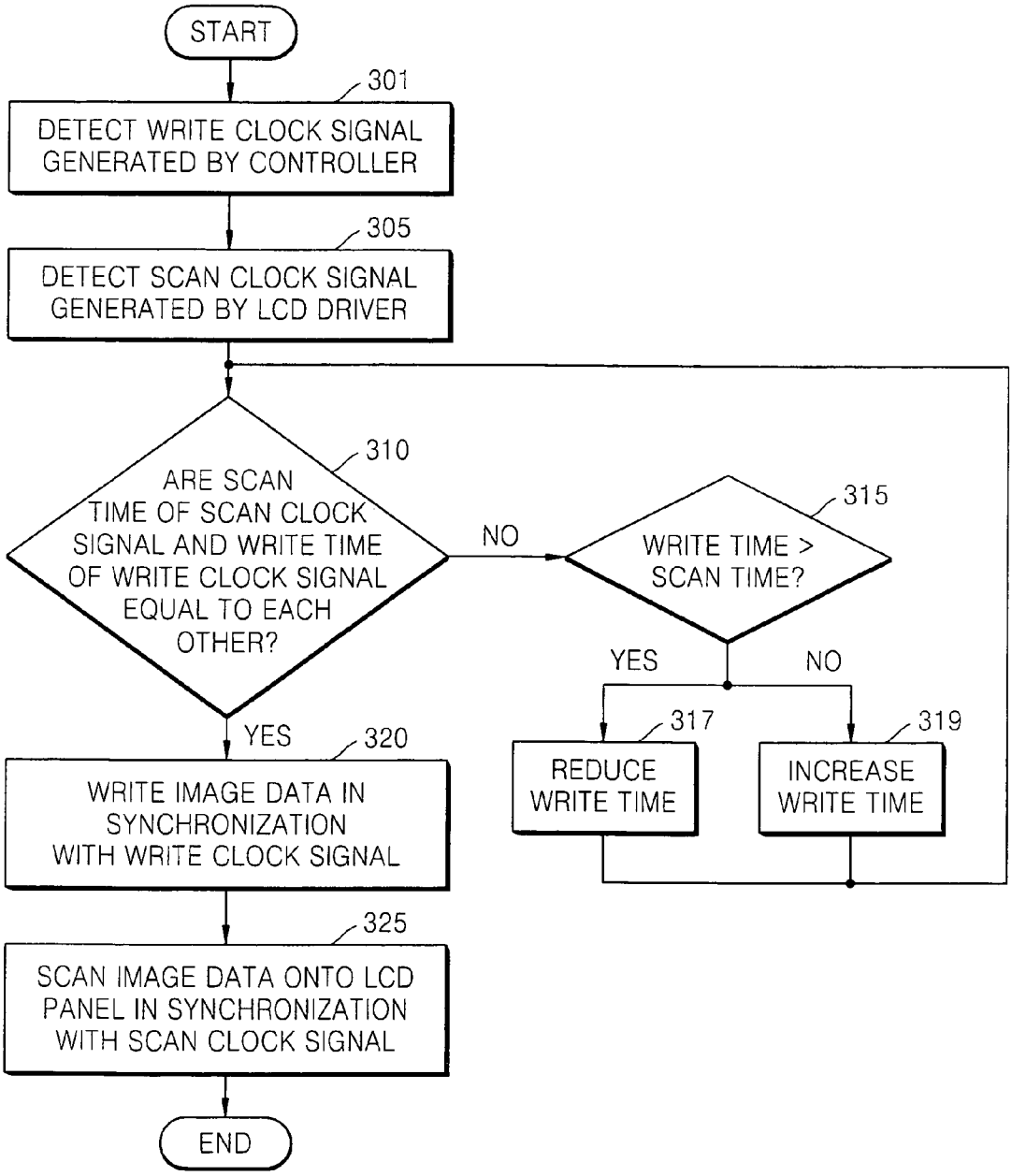
FIG. 3 is a flowchart of methods for reducing/avoiding the tearing effect according to a first exemplary embodiment of the present invention.

FIG. 3 is a flowchart of methods for reducing/avoiding a tearing effect according to a first exemplary embodiment of the present invention.

Referring to FIG. 3, a write clock signal CLK_W generated by a controller is detected in operation 301. More particularly, the active period duration (time) of the write clock signal CLK_W can be detected. Hereinafter, the active period duration of the write clock signal CLK_W will be referred to as "write time." The write clock signal CLK_W is used by the controller to write image data through a write operation into a memory in the LCD driver.

A scan clock signal CLK_FLM is detected in operation 305. The scan clock signal CLK_FLM is used by the LCD driver to perform a scan operation with respect to an LCD panel, so as to scan image data from the memory into an image that is displayed on the LCD panel. The active period duration (time) of the scan clock signal CLK_FLM is detected. Hereinafter, the active period duration of the scan clock signal CLK_FLM will be referred to as "scan time."

A determination is made in operation 310 as to whether the scan time of the scan clock signal CLK_FLM and the write time of the write clock signal CLK_W are equal to each other. If not, a further determination is carried out in operation 315 as to whether the write time is greater than the scan time.

When the write time is greater than the scan time, the write time of the write clock signal CLK_W is reduced in operation 317 to be equal to the scan time.

When the write time is less than the scan time, the write time of the write clock signal CLK_W is increased in operation 319 to be equal to the scan time.

When the scan time and the write time are equal to each other, in operation 310, the controller writes image data in operation 320 to the memory of the LCD driver synchronously with the adjusted write clock signal CLK_W.

The LCD driver then performs in operation 325 a scan operation to display the image data on the LCD panel synchronously with the scan clock signal CLK_FLM.

Accordingly, the write time of the write clock signal CLK_W is adjusted (regulated) in response to the scan time of the scan clock CLK_FLM, so as to cause the controller to write image data at the same speed that the LCD driver scans image data onto the LCD panel. Consequently, an intersecting timing point between the write clock signal CLK_W and the scan clock signal CLK_FLM is avoided, which may prevent the occurrence of a tearing effect in the image displayed in the LCD panel. Moreover, the write clock signal CLK_W can be dynamically adjusted to respond to changes in the operating frequency of the scan clock signal CLK_FLM, which can thereby compensate for signaling changes from circuitry that is external to the LCD device.

Figure 4A:
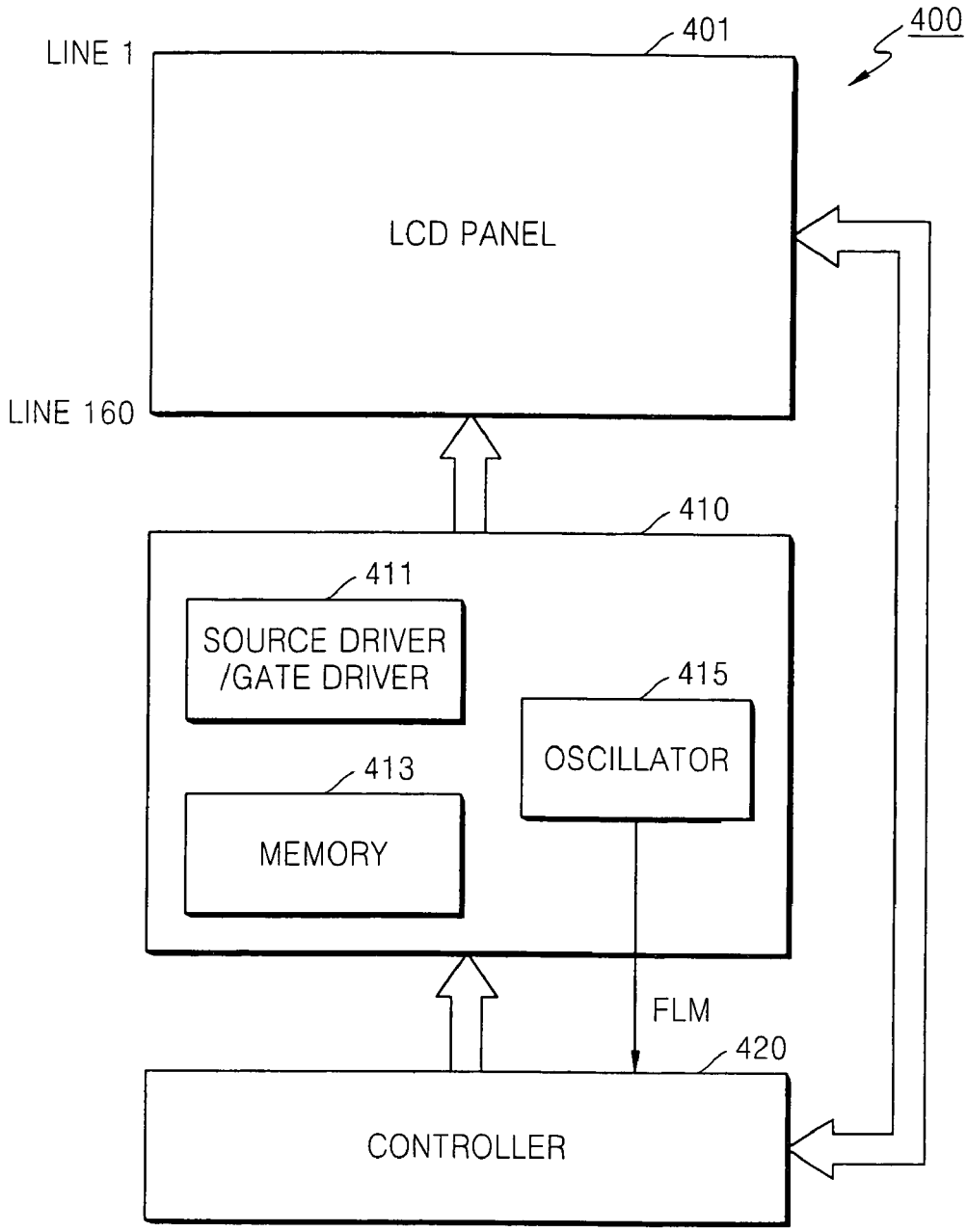
FIG. 4A illustrates an LCD device configured to reducing/avoid the tearing effect according to a second exemplary embodiment of the present invention.

FIG. 4A illustrates an LCD device 400 that is configured to reduce/avoid occurrence of a tearing effect and a display image in accordance with a second exemplary embodiment of the present invention. The LCD device 400 may be configured to operate according to the methods described above with regard to FIG. 3.

Referring to FIG. 4A, the LCD device 400 includes an LCD panel 401, an LCD driver 410, and a controller 420. The LCD driver 410 includes a source driver/gate driver 411, a memory 413, and an oscillator 415.

The source driver/gate driver 411 retrieves image data that is stored in the memory 413 and outputs, in response thereto, an image signal to the LCD panel 401 in response to a control signal generated by the controller 420. The image signal may contain image data that was received from circuitry external to the LCD device 400, or may include image data that has been further processed to, for example, cancel noise and/or improve image that will be displayed. The image signal may be, for example, a red(R)/green(G)/blue(B) signal.

The source driver/gate driver 411 responds to the control signal from the controller 420 by controlling positioning of where the image signal is to be displayed on the LCD panel 401.

The oscillator 415 generates a scan clock signal CLK_FLM that is used by the LCD driver 110 to scan the image signal from the source driver/gate driver 411 onto the LCD panel 401 for display.

The controller 420 controls display of the image data onto the LCD panel 401. The controller 420 may, for example, process image data that is received from an external complementary metal-oxide-semiconductor (CMOS) image sensor to generate image data, and/or it may determine when and how the generated image data is to be displayed on the LCD panel 401. The controller 120 generates and outputs control signals such as a CS signal, a WR signal, a DATA signal and the like, so that the image data can be output to the LCD driver 410 and displayed through the LCD panel 401.

The CS signal is a chip selection signal that is used to select and enable individual pixels on the LCD panel 401, so that the individual pixels can be controlled in response to the image data to display a screen image on the LCD panel 401. The WR signal is a write clock signal that is used to write data, which is received from circuitry external to the LCD device 400, into a memory 413 in the LCD driver 410. As described above, the write clock signal is referred to as CLK_W. The DATA signal contains image data that is received from circuitry external to the LCD device 400.

The controller 420 generates the control signals in order to define which pixels and at what time image data is to be displayed, and thereby controls the display of the image data on the LCD panel 410 through the LCD driver 410.

The controller 420 receives scan time information FLM for the scan clock signal CLK_FLM from the oscillator 415. The controller 420 adjusts a write time of the write clock signal CLK_W generated inside the controller 420 in response to the scan time information FLM. Adjustment of the write clock signal CLK_W by adjustment of the write time may, for example, be carried out only once during an initial stage of displaying a moving image. Alternatively, the write clock signal CLK_W may be repetitively adjusted, such as being periodically adjusted at defined intervals.

Figure 2A:
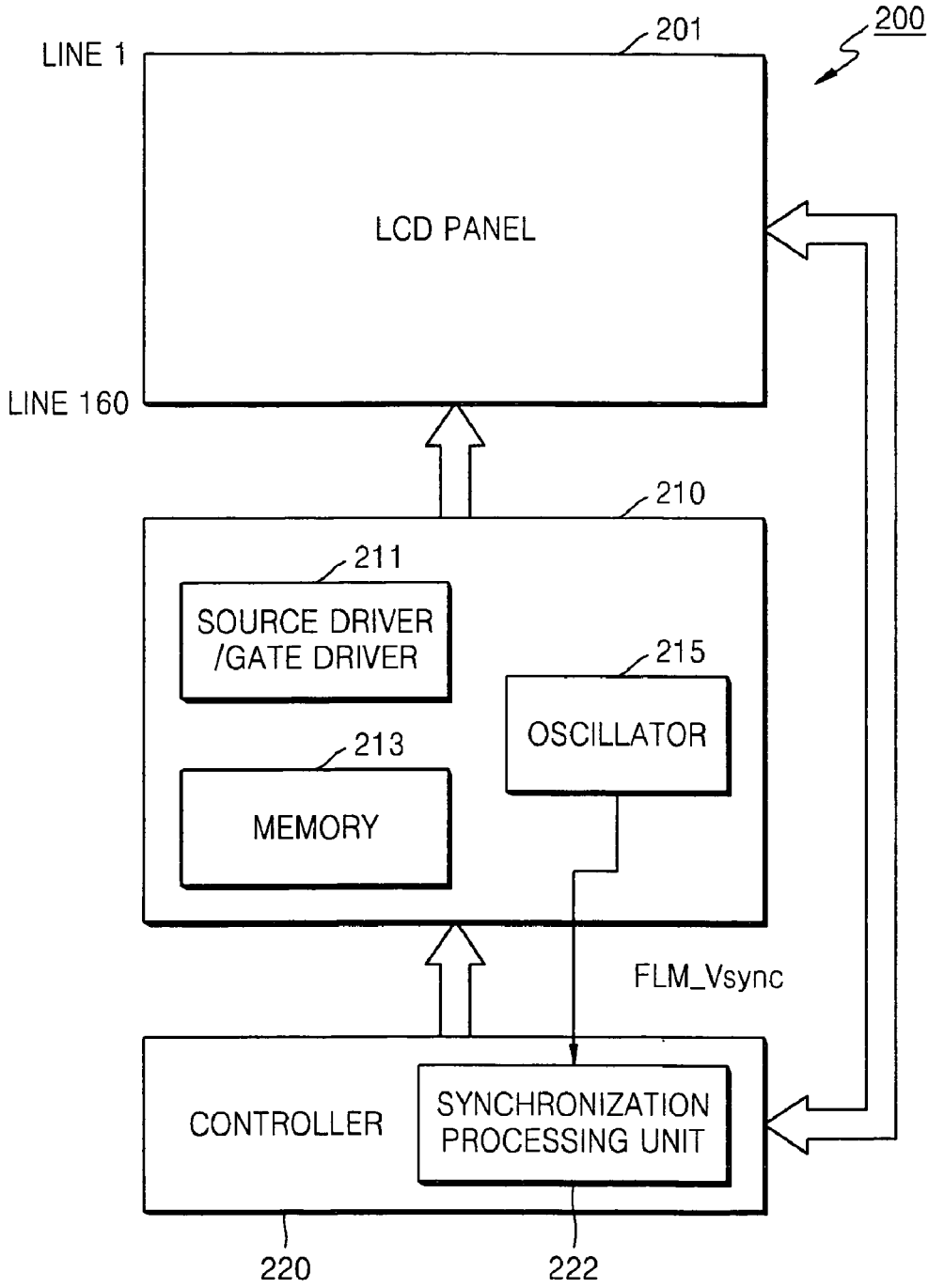
FIG. 2A (RELATED ART)
FIG. 2A illustrates a conventional LCD device that is configured to attempt to prevent the occurrence of a tearing effect.
Figure 2B:
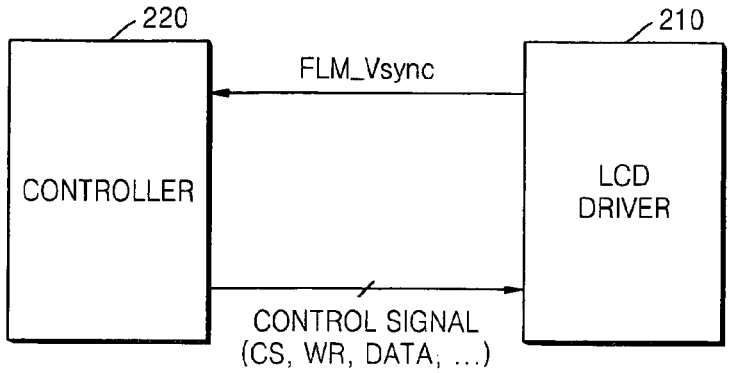
FIG. 2B (RELATED ART)
FIG. 2B is a block diagram that illustrates various operations of the controller and the LCD driver illustrated in FIG. 2A.
Figure 2C:
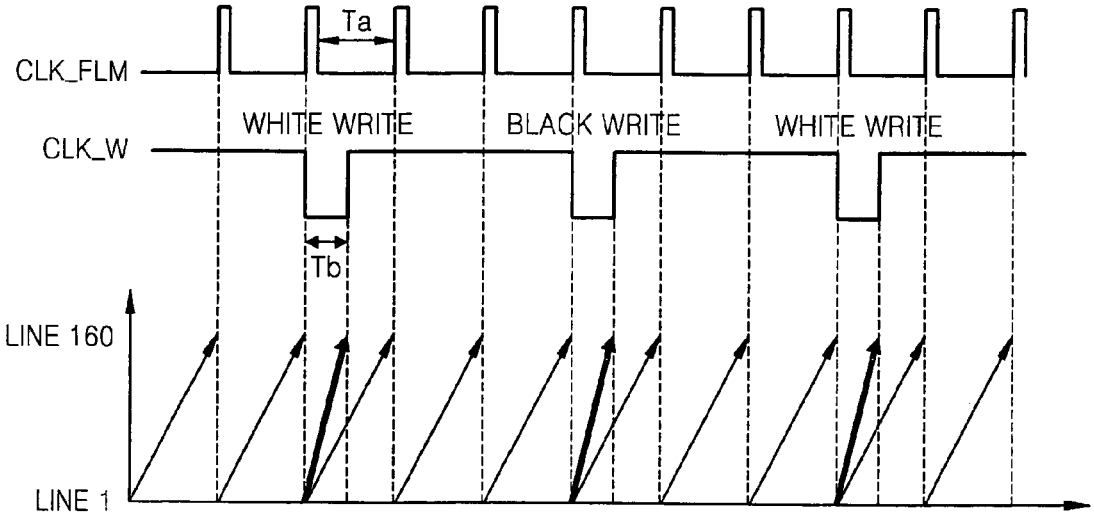
FIG. 2C (RELATED ART)
FIG. 2C is a timing diagram that illustrates relative timing between the write clock signal CLK_W and the scan clock signal CLK_FLM during the operation of the LCD device of FIG. 2A.

As described above, the conventional LCD device 200 of FIG. 2A receives a synchronization information signal FLM_Vsync of the scan clock signal CLK_FLM in response to activation of the write clock signal CLK_W. For this reason, the LCD device 200 needs to include a separate processor to avoid the need for interrupt processing. In sharp contrast, the LCD device 400 may be configured to operate without use of a separate processor and while avoiding the need for interrupt processing. Moreover, by dynamically changing the write time in response to variation in the scan time, the occurrence of tearing effect in displayed images may be reduced/prevented.

Figure 4B:
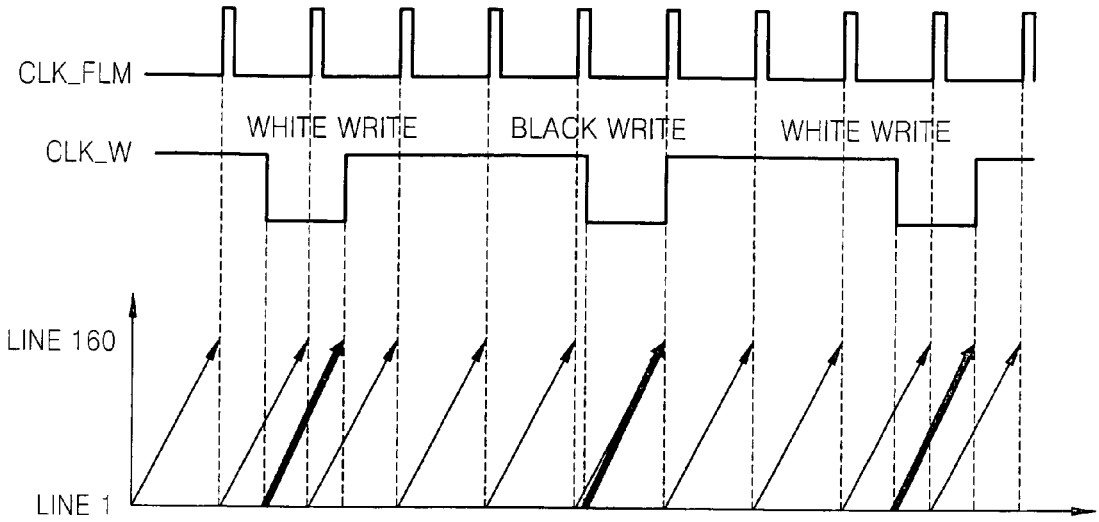
FIG. 4B is a timing diagram that illustrates relative timing between the write clock signal CLK_W and the scan clock signal CLK_FLM during exemplary operation of the LCD device of FIG. 4A.

FIG. 4B is a timing diagram that illustrates relative timing between the write clock signal CLK_W and the scan clock signal CLK_FLM during exemplary operation of the LCD device 400 illustrated in FIG. 4A.

According to the present example, the LCD device 400 has a write time T2 and a scan time T1 which are equal to each other, such that the speed at which image data is written to the memory 413 is equal to the speed at which image data is scanned onto the LCD panel 401. Consequently, the write clock signal CLK_W and the scan clock signal CLK_FLM may not exhibit the intersecting timing and intersecting point "a" shown in FIG. 1A. Consequently, the LCD device 400 may not exhibit a tearing effect in displayed images.

As described above, when a write clock signal of a display memory and a scan clock signal for the display are asynchronous relative to one another, the tearing effect in displayed images can be reduced/avoided without necessitating the use of a separate processor for synchronization and interrupt processing. Because the write time and scan time can be made equal, a tearing effect may be prevented/reduced in displayed images despite variations in the frequency of an LCD driver and/or in clock signals.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A liquid crystal display device comprising:

a liquid crystal display panel;

a controller that is configured to receive image data from circuitry external to the liquid crystal display device and to generate a write clock signal defining a write time; and a liquid crystal display driver that is configured to store image data from the controller at a rate defined by the write time of the write clock signal, to generate a scan clock signal having a scan time, and to generate an image signal in response to the stored image data, the image signal having a rate defined by the scan time of the scan clock signal, wherein the liquid crystal display driver scans the image signal into the liquid crystal display panel at the rate defined by the scan time of the scan clock signal to display an image on the liquid crystal display panel, wherein the controller regulates the write time of the write clock signal in response to a comparison of the scan time of the scan clock signal to the write time of the write clock signal, wherein the controller detects the write time of the write clock signal, detects the scan time of the scan clock of the scan clock signal, compares the scan time of the scan clock signal to the write time of the write clock signal, and adjusts the write time of the write clock signal in response to the comparison, and wherein the controller responds to the write time being greater than the scan time by reducing the write time, and responds to the write time being less than the scan time by increasing the write time, so that the controller adjusts the write time of the write clock signal to be equal to the scan time of the scan clock signal.

2. The liquid crystal display device of claim 1, wherein:

the liquid crystal display driver comprises a memory; and the liquid crystal display driver writes the image data from the controller into the memory at the rate defined by the write time of the write clock signal.

3. The liquid crystal display device of claim 2, wherein the liquid crystal display driver further comprises an oscillator that generates the scan clock signal.

4. The liquid crystal display device of claim 2, wherein the liquid crystal display driver further comprises:

a source driver that is configured to read the image data from the memory and to output the image signal to the liquid crystal display panel at a rate defined by the write time of the write clock signal; and a gate driver that is configured to respond to the write clock signal to control a position where the image signal is to be displayed.

5. The liquid crystal display device of claim 1, wherein:

the liquid crystal display driver comprises a memory;

the image data comprises color information; and the liquid crystal display driver is further configured to output the color information from the memory to the liquid crystal display panel to control colors of pixels of the liquid crystal display panel in response to the scan clock signal.

6. The liquid crystal display device of claim 5, wherein the liquid crystal display driver is further configured to repetitively display the color information for an entire screen of pixels of the liquid crystal display panel at a rate corresponding to the scan time, and to repetitively write to the memory the color information for an entire screen of pixels of the liquid crystal display panel at a rate corresponding to the write time.

* * * * *